US007429204B2

(12) United States Patent
Reuter et al.

(10) Patent No.: US 7,429,204 B2
(45) Date of Patent: Sep. 30, 2008

(54) TOY VEHICLE HAVING AN ELECTRIC DRIVE

(75) Inventors: Uwe Reuter, Althengstett (DE); Thomas Weidner, Besigheim (DE); Ralf Kroener, Bietigheim-Bissingen (DE); Cong-Uan Doan, Muehlacker (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 624 days.

(21) Appl. No.: 11/076,247

(22) Filed: Mar. 10, 2005

(65) Prior Publication Data

US 2005/0208869 A1 Sep. 22, 2005

(30) Foreign Application Priority Data

Mar. 11, 2004 (DE) ..... 10 2004 011 932

(51) Int. Cl.
*A63H 17/00* (2006.01)
*A63H 30/00* (2006.01)

(52) U.S. Cl. ..... 446/94; 446/454; 446/469

(58) Field of Classification Search ..... 446/454–456, 446/465, 469, 85, 93–94; 104/53, 60
See application file for complete search history.

(56) References Cited

U.S. PATENT DOCUMENTS

| | | | | |
|---|---|---|---|---|
| 3,752,246 | A * | 8/1973 | Sullivan | 180/56 |
| 4,643,102 | A * | 2/1987 | Arnau Manresa | 104/305 |
| 4,764,150 | A | 8/1988 | Uchino | |
| 5,338,247 | A * | 8/1994 | Miles | 446/456 |
| 6,595,824 | B2 | 7/2003 | Calello et al. | |
| 2005/0202747 | A1 * | 9/2005 | Reuter et al. | 446/290 |
| 2005/0208871 | A1 * | 9/2005 | Reuter et al. | 446/446 |
| 2005/0215173 | A1 * | 9/2005 | Reuter et al. | 446/436 |

FOREIGN PATENT DOCUMENTS

WO WO 03/031007 A1 4/2003

* cited by examiner

*Primary Examiner*—Robert E Pezzuto
*Assistant Examiner*—Alex F. R. P. Rada, II
(74) *Attorney, Agent, or Firm*—Crowell & Moring LLP

(57) ABSTRACT

A toy vehicle with an electric drive is provided that is suitable for operation on a racetrack, and has a chassis with a rear-axle unit, including an electric motor, and a front-axle unit. In order to optimize the toy vehicle with respect to the type of construction and driving characteristics, the chassis has a center frame device extending between the rear-axle unit carrying the electric motor and the front-axle unit, on which center frame part, the rear-axle unit and the front-axle unit constructed in the manner of modules are held in position.

13 Claims, 4 Drawing Sheets

TOY VEHICLE HAVING AN ELECTRIC DRIVE

BACKGROUND AND SUMMARY OF THE INVENTION

This application claims the priority of German Application No. 10 2004 011 932.5, filed Mar. 11, 2004, the disclosure of which is expressly incorporated by reference herein.

The invention relates to a toy vehicle having an electric drive, for example, a toy vehicle that operates on a race track. Such a toy vehicle has a chassis having a rear-axle unit, including an electric motor, and a front-axle unit.

From U.S. Pat. No. 6,595,824 B2, a vehicle concept for play purposes is known, by which a series of different vehicles—coupes, pick-up trucks or the like—can be reproduced. This vehicle concept comprises several elements, specifically, a center part, a rear-axle unit and a front-axle unit. Between the above-mentioned elements, holding devices are provided, which are constructed in the manner of snap connections.

U.S. Pat. No. 4,746,150 relates to a drivable toy vehicle having a rear-axle unit and a front-axle unit, which bound a center part. The rear-axle unit comprises a rear axle with wheels and an electric motor. For driving the rear wheels, a transmission is provided, which is formed by gearwheels. The front axle unit has a carrying body to which wheels are fastened by means of links.

It is an object of the invention to create a chassis having a front-axle unit and a rear-axle unit for a toy vehicle, which chassis is distinguished by a simple, but highly effective, type of construction. However, it should also be ensured in this case that the chassis is suitable for various superstructures for which different wheelbases are required on the chassis.

According to the invention, this object is achieved by providing a toy vehicle having a chassis having a rear-axle unit, including an electric motor, and a front-axle unit. The chassis has a center frame part that extends between the rear-axle unit carrying the electric motor and the front-axle unit. The center frame part, the rear-axle unit and the front-axle unit are held in position The rear-axle unit and the front-axle unit are constructed in the manner of modules. Additional characteristics further developing the invention are described and claimed herein.

An advantage of the present invention is that the chassis with its rear-axle unit, its front-axle unit and the center frame device represents an exemplary and easily implementable construction. This is also promoted by the fact that the rear-axle unit and the front-axle unit are constructed as modules, which are fastened to the chassis by way of constructionally simple devices. The center frame device has a base frame and a receiving frame for the rear-axle unit and the front-axle unit. In this case, the base frame and the receiving frame are constructed such that, depending on the length of the base frame—viewed in the longitudinal direction of the vehicle—a defined wheelbase is obtained between the rear wheels of the rear-axle unit and the front wheels of the front-axle unit. As a result of this construction, while the receiving frame of the rear-axle unit and of the front-axle unit are maintained—use of identical parts—vehicle bodies of different sizes can be combined with a corresponding wheelbase.

A front-axle support of the front-axle unit, which has parallel side members, extends to the receiving frame, in which side members threaded bores are provided for the targeted connection of the front-axle unit with the base frame. Finally, by means of a plug-type connection, the rear-axle unit is connected with the receiving frame of the center frame device, which plug-type connection is distinguished by a neatly designed construction principle and can have a defined elasticity. By means of the latter, driving-dynamic effects of the toy vehicle can be implemented.

Other objects, advantages and novel features of the present invention will become apparent from the following detailed description of the invention when considered in conjunction with the accompanying drawings.

DETAILED DESCRIPTION OF THE DRAWINGS

Figure 1:
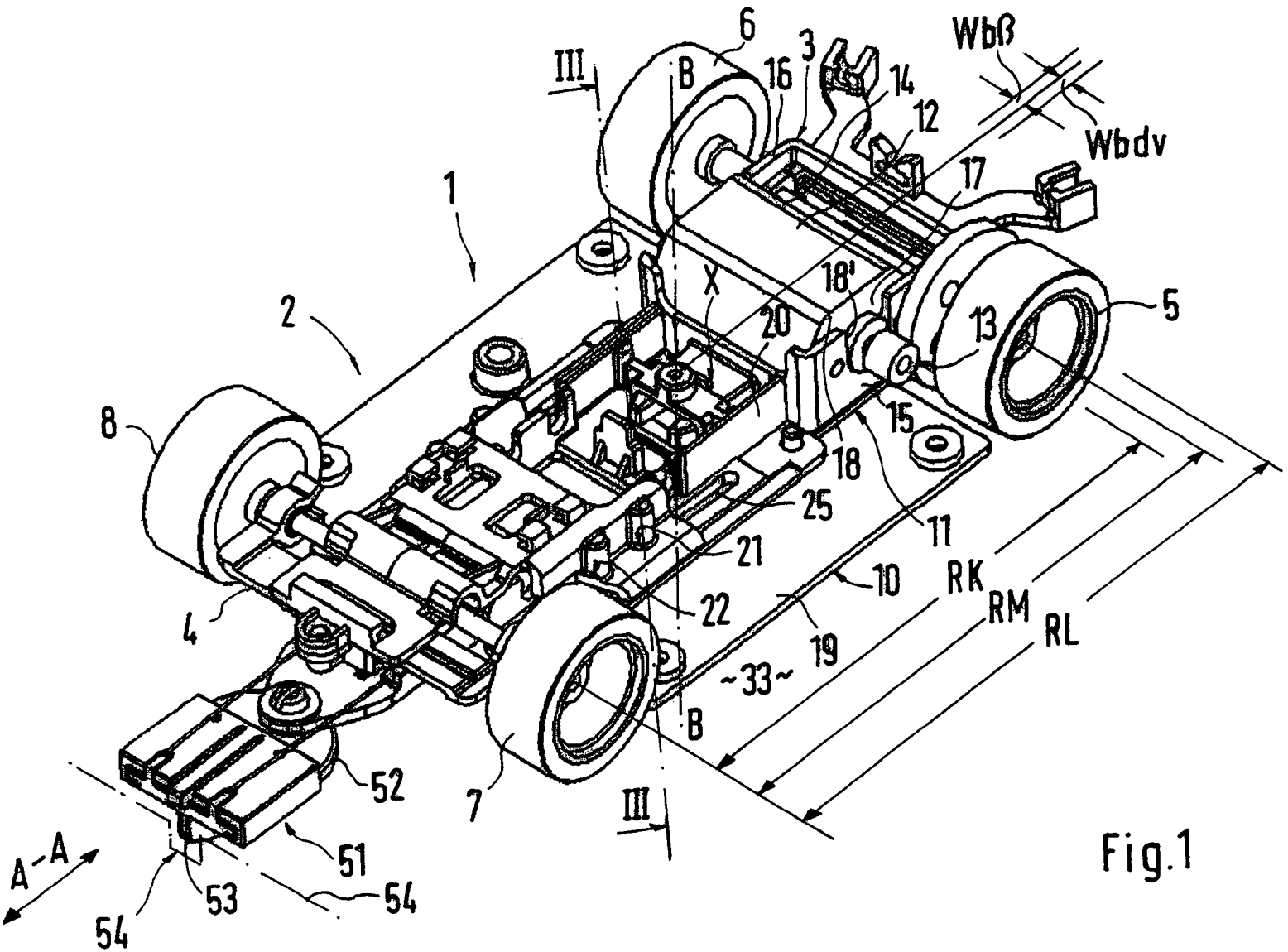
FIG. 1 is a perspective view of a chassis of a toy vehicle according to the invention.

Of a track-guided toy vehicle 1 constructed for use on a racetrack, only a chassis 2 is illustrated, which has a rear-axle unit 3 and a front-axle unit 4. The rear-axle unit 3, including the rear wheels 5 and 6, as well as the front-axle unit 4 having the front wheels 7 and 8 are fastened to a center frame device 10 of the chassis 2. The center frame device 10 extends between the rear wheels 5 and 6 as well as the front wheels 7 and 8.

Figure 2:
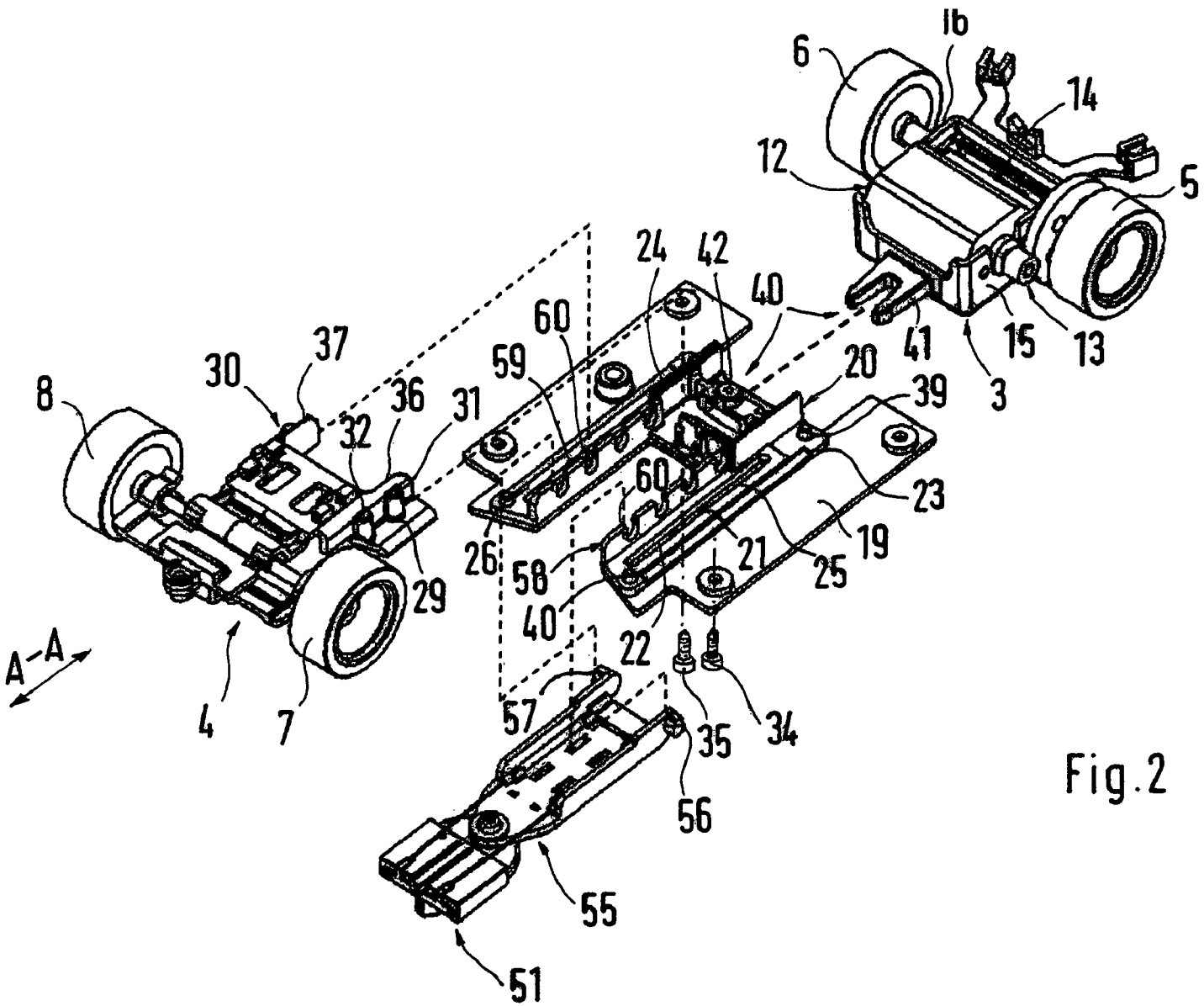
FIG. 2 is an exploded view of the chassis according to FIG. 1.
Figure 3:
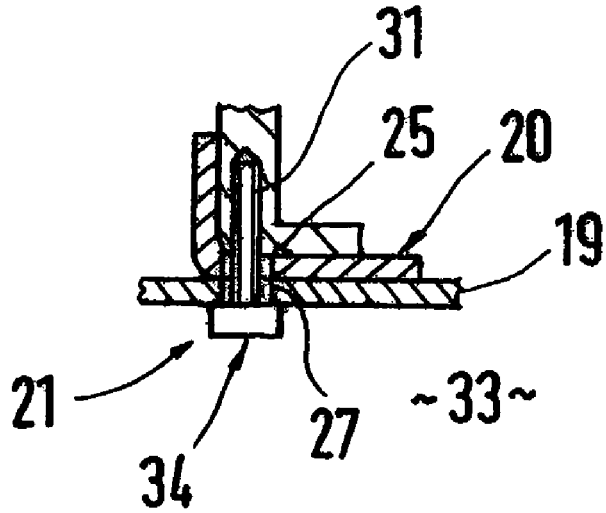
FIG. 3 is an enlarged sectional view taken along Line III-III of FIG. 1.

The rear axle unit 3 and the front axle unit 4 have a module-type construction (see FIG. 2). The rear-axle unit 3 includes a supporting frame 11 for an electric motor 12, which is installed transversely to the longitudinal direction A-A of the vehicle and which, by way of a toothed gearing 13, drives a drive shaft 14 equipped with the rear wheels 4 and 5. The drive shaft 14 is arranged on supporting walls 15 and 16 of the supporting frame 11 illustrated in the manner of a cage, which supporting walls 15 and 16 are aligned in the longitudinal direction A-A of the vehicle. At least the supporting wall 15 is provided with a recess 17 in which a journal 18' rests, which journal is mounted on a face 18 of the electric motor 12 and corresponds with the recess 17.

The center frame device 10 includes a base frame 19 with a receiving frame 20 for the rear-axle unit 3 and the front-axle unit 4. The base frame 19 and the receiving frame 20 are constructed in such a manner that—viewed in the longitudinal direction A-A of the vehicle—depending on the constructive defining of fastening points 21 and 22 on the base frame 19, a defined wheelbase—medium wheel base Rm, long wheel base Rl and short wheel base Rk—is obtained. By way of supporting plates 23 an 24, the receiving frame 20 rests on the base frame 19, in which supporting plates 23 and 24 slot-type openings 25 and 26 are provided which extend in the longitudinal direction A-A of the vehicle. The slot-type openings 25 and 26 are accessible by way of bores 27 in the base frame 19 embodying the fastening points 21 and 22. In the area of the bores 27 or of the fastening points 21 and 22 of the base frame 19, the front-axle unit 4 is provided with supporting elements 29, 30 into which upright threaded bores 31 and 32 are machined. From the underside 33 of the base frame 19, screws 34 and 35 are screwed into the threaded bores 31 and 32, which screws 34 and 35 penetrate the bores 27 and the slot-type openings 25 and 26.

The threaded bores 31 and 32 are integrated in a front-axle support 30 having parallel side members 36 and 37. Furthermore, the plate-shaped base frame 19 and the receiving frame 20 are mutually connected by means of rivets 39, screws or the like.

Figure 4:
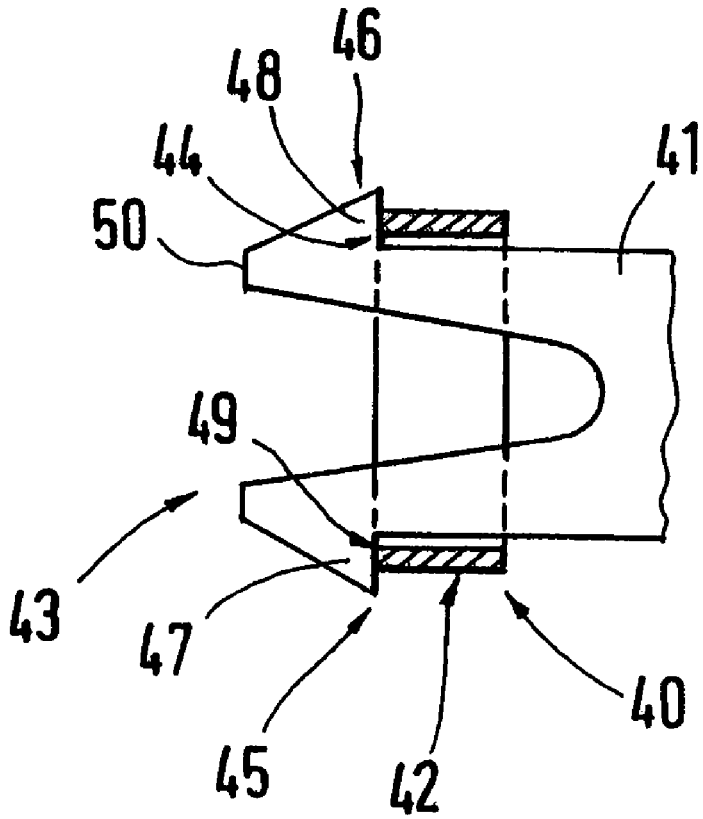
FIG. 4 is a top view of a plug-type connection of the chassis.
Figure 5:
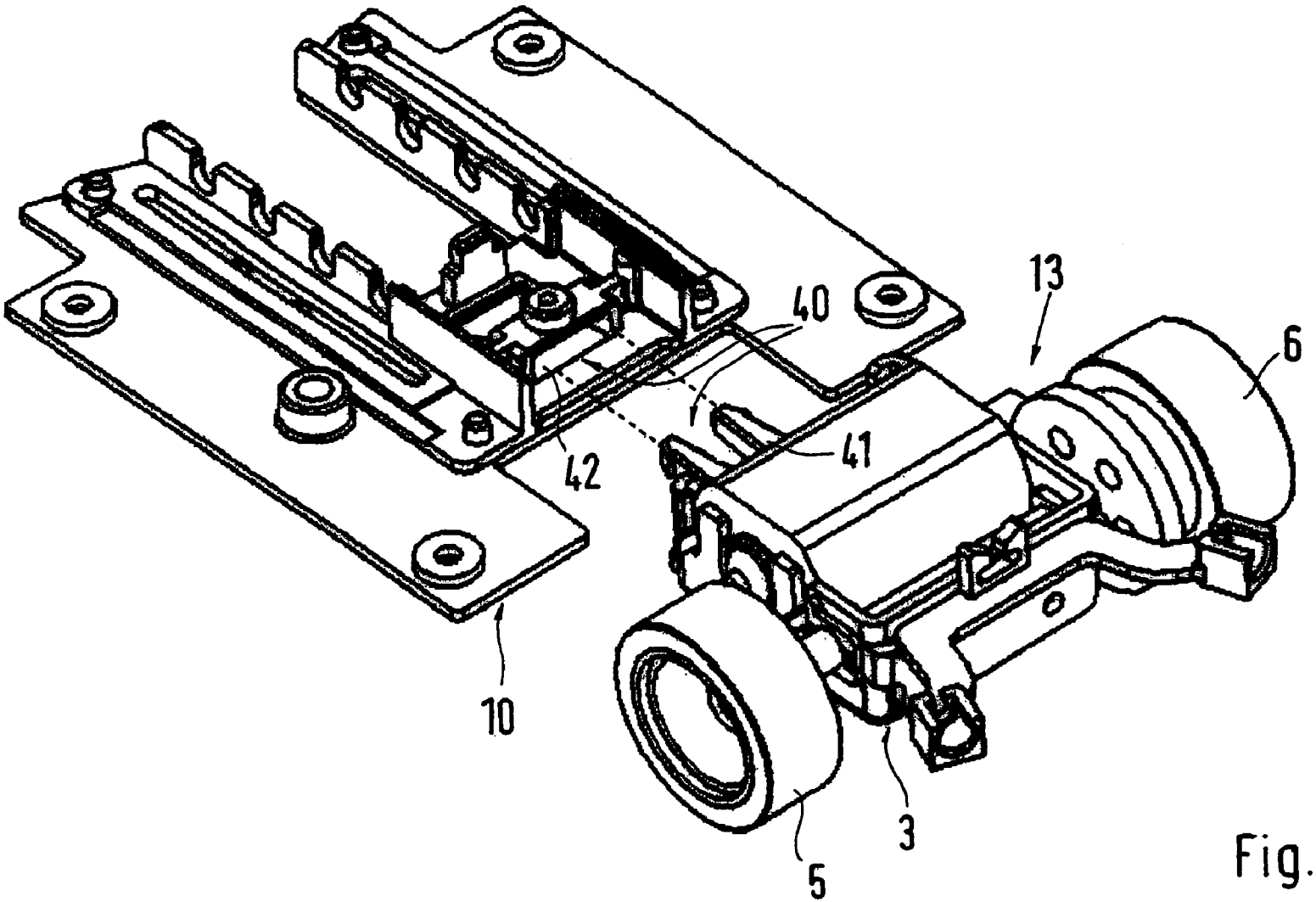
FIG. 5 is a perspective rear view of a rear-axle unit of the chassis.

By using a plug-type connection 40 (see FIG. 4), the rear-axle unit 3 is assembled with the center frame device 10 of the chassis 2. The plug-type connection 40 is formed by a tension fork 41 and a receiving device 42. The tension fork 41 held on a transverse wall 43 of the supporting frame 11 engages in the receiving device 42 having a rectangular shape. In this case, the tension fork 41 and the receiving device 42 may be designed such that, in the driving operation of the toy vehicle 1, for achieving driving-dynamic effects (elastokinematics), to a limited extent, angular movements Wba and Wbp occur approximately about a vertical axis B-B between the receiving frame 20 and the rear-axle unit 3. The tension fork 41 has spaced prongs 43 and 44, whose exterior sides 45 and 46 have barb-type expansions 47 and 48 which, in turn, are supported on supporting walls 49 and 50 of the receiving device 42.

Adjacent to the front-axle unit 4, a guiding device 51 is provided on the receiving frame 20 of the chassis 2, which guiding device 51 has a current collector 52 for the electric motor 12 and a nose-type guiding element 53 which projects into a guide groove 54 of a racetrack 54. The guiding device 51 is constructed as a rocking lever 55 which can be moved about a horizontal axis and comprises the journals 56 and 57. For the journals 56 and 57, several journal receiving devices 60 are arranged on the receiving frame 20 on upright walls 58 and 59, which journal receiving devices 60 permit the adjusting of the position of the rocking lever 55 in the longitudinal direction A-A of the vehicle.

Finally, a suitable plastic material can be used for producing the different components 2 of the chassis, such as the supporting frame 11, the base frame 19, the receiving frame 20 and the front-axle supports 38. However, it is also contemplated to use metallic materials or a mixed construction, such as plastic material and a metal.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electrically driven toy vehicle, comprising:

a chassis comprising a rear-axle unit carrying an electric motor and a front-axle unit;

the chassis further comprising a center frame part extending between the rear-axle unit and the front-axle unit;

wherein the rear-axle unit and the front-axle unit are held in position on the center frame part and at least the rear axle unit is connected with the center frame part by a plug-type connection, the rear-axle unit and the front-axle unit being constructed as separate modules; and wherein the plug-type connection between the rear-axle unit and the center frame part has a tension fork, which engages in a rectangular receiving device of the center frame device.

2. The toy vehicle according to claim 1, wherein the center frame device comprises a base frame with a receiving frame for the rear-axle unit and the front-axle unit; and further wherein the base frame and the receiving frame are constructed such that a defined wheelbase is obtained between rear wheels of the rear axle unit and front wheels of the front-axle unit in accordance with fastening points on the base frame for the front-axle unit when viewed in a longitudinal direction of the vehicle.

3. The toy vehicle according to claim 2, wherein the receiving frame rests via supporting plates on the base frame, in which supporting plates slot-type openings are provided which extend in the longitudinal direction of the vehicle and which are accessible by way of bores in the base frame, and further wherein the front-axle unit, in an area of the bores, comprises supporting elements with upright threaded bores, into which screws are screwed which, from an underside of the base frame penetrate the bores and the slot-type openings.

4. The toy vehicle according to claim 3, wherein the threaded bores are provided in a front-axle support of the front-axle unit having parallel side members.

5. The toy vehicle according to claim 2, wherein the base frame and the receiving frame are connected with one another via rivets or screws.

6. The toy vehicle according to claim 1, wherein the rear-axle unit has a receiving device for the electric motor, which is installed transversely with respect to the longitudinal direction of the vehicle, and for the axle shaft.

7. The toy vehicle according to claim 6, wherein the electric motor has a journal at least on a face, which journal rests in a corresponding recess of a supporting wall of the supporting frame.

8. The toy vehicle according to claim 1, wherein exterior sides of prongs of the tension fork are provided with barb-type expansions, which are supported on supporting walls of the receiving device.

9. The toy vehicle according to claim 1, wherein the plug-type connection is constructed such that, in a driving operation of the toy vehicle, to a limited extent, angular movements occur about an approximately horizontal axis between a receiving frame and the rear-axle unit.

10. The toy vehicle according to claim 1, further comprising a guiding device including a current collector, which guiding devices is configured to engage in a guide groove of a racetrack, wherein the guiding device is fastened to a rocking lever.

11. The toy vehicle according to claim 10, wherein the rocking lever is disposed on walls of the receiving frame.

12. The toy vehicle according to claim 11, wherein the rocking lever is constructed to be variable in its position in the longitudinal direction of the vehicle.

13. The toy vehicle according to claim 10, wherein the rocking lever is constructed to be variable in its position in the longitudinal direction of the vehicle.

* * * * *